US007600498B2

(12) United States Patent
Diggs

(10) Patent No.: US 7,600,498 B2
(45) Date of Patent: Oct. 13, 2009

(54) INTERNAL COMBUSTION ENGINE WITH GAS EXCHANGE VALVE DEACTIVATION

(75) Inventor: Matthew Diggs, Farmington, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 299 days.

(21) Appl. No.: 11/679,459

(22) Filed: Feb. 27, 2007

(65) Prior Publication Data

US 2008/0202455 A1 Aug. 28, 2008

(51) Int. Cl.
*F01L 1/18* (2006.01)

(52) U.S. Cl. ..... 123/90.39; 123/90.16; 123/90.41; 29/888.2; 74/559

(58) Field of Classification Search ..... 123/90.16, 123/90.39, 90.44, 90.4, 90.41; 74/559, 567, 74/569; 29/888.2
See application file for complete search history.

(56) References Cited

U.S. PATENT DOCUMENTS 4,221,201 A 9/1980 Soeters, Jr.
4,222,354 A 9/1980 Uitvlugt
4,227,494 A 10/1980 Uitvlugt
4,380,219 A * 4/1983 Walsh ..... 123/198 F
4,509,467 A 4/1985 Arai et al.

* cited by examiner

*Primary Examiner*—Ching Chang
(74) *Attorney, Agent, or Firm*—Julia Voutyras; Brooks Kushman P.C.

(57) ABSTRACT

An internal combustion engine with selectively deactivated intake and/or exhaust valves includes a fulcrum plate having a through hole with a slidable plunger supporting a pivot ball that engages an associated rocker arm. A solenoid positioned above the rocker arm cover is directly coupled to a latching mechanism that either allows or prevents sliding movement of the plunger to selectively deactivate associated intake/exhaust valves. When in the valve activated position, the rocker arm pivots about the pivot ball and opens the valve. When in the valve deactivated position, the plunger retracts at least partially into the fulcrum plate so that the rocker arm motion is insufficient to open the associated valve. A lost motion torsional spring acts on the plunger to provide an opposing force to the rocker arm and to return the plunger to the valve activated position during the base circle portion of camshaft rotation.

19 Claims, 3 Drawing Sheets

INTERNAL COMBUSTION ENGINE WITH GAS EXCHANGE VALVE DEACTIVATION

BACKGROUND

1. Technical Field

The present disclosure relates to an internal combustion engine having a device for selectively deactivating one or more intake and/or exhaust valves.

2. Background Art

Conventional internal combustion engines use a camshaft-driven valvetrain to operate intake and exhaust valves that control the exchange of gases and fuel in the combustion chambers formed between the engine block and cylinder head. In overhead cam valvetrains, camshaft lobes directly drive rocker arms that actuate the valves, whereas "cam-in-block" or pushrod engines use pushrods to couple camshaft lobes to corresponding rocker arms. Relatively thin (or flat) rocker arms that pivot about a ball supported by a pedestal or fulcrum secured to the engine block have been developed to facilitate actuation of multiple valves per cylinder as disclosed in commonly owned and copending U.S. patent application Ser. No. 11/308,021 filed Mar. 3, 2006. This arrangement actuates all the associated intake/exhaust valves for each camshaft revolution.

Under various engine, vehicle, and/or ambient operating conditions it may be desirable to selectively deactivate one or more valves for one or more cylinders, i.e. to selectively prevent one or more intake and/or exhaust valves from opening either for all engine cylinders or a subset of cylinders during starting, stopping, or running of the engine. Representative applications for selective valve deactivation may include variable displacement engines or cylinder cut-off systems that operate on a subset of cylinders under selected conditions; deactivation of one intake valve on a multiple intake valve-per-cylinder engine to improve swirl motion at selected engine speeds; and deactivating valves during engine starting and/or running to vary exhaust temperature and manage operating temperature of emission treatment devices, for example.

Regardless of the particular application for a valve deactivation system, it is generally desirable to be able to reliably synchronize valve deactivation and subsequent re-activation with other engine events, such as fuel injection and piston position, for example. In addition, it is desirable for the system to not impact valvetrain performance by adding mass to moving components; to be implemented without changes to complex parts such as the cylinder block, cylinder head, or engine lubrication system; to be compact and light-weight; and to be capable of use in multiple-valve-per-cylinder gas and diesel engines.

SUMMARY

A system and method for selectively deactivating at least one intake/exhaust valve of an internal combustion engine include a fulcrum plate having a through hole with a plunger having a pivot ball cup at one end disposed within the through hole and slidable within the hole when a corresponding latching mechanism is in a valve-deactivated position. The latching mechanism limits sliding movement of the plunger into the through hole of the fulcrum plate when in a valve-activated position so the rocker arm pivots about the ball and opens the associated valve. The latching mechanism allows sliding movement of the plunger, which is opposed by a torsional lost motion spring, into the through hole of the fulcrum plate when in a deactivated position so that rocker arm motion is insufficient to open the associated valve. The latching mechanism is actuated by a mechanically coupled solenoid positioned above the rocker arm cover in response to a control signal from the engine or vehicle controller.

In one embodiment according to the present disclosure, an internal combustion engine having a plurality of gas exchange valves associated with each cylinder includes at least one valve selectively deactivated in response to a command signal. The engine includes independently pivotable rocker arms each associated with one of the gas exchange valves with each rocker arm including a central opening defined by a bottom wall having an integrally formed pivot ball socket. A fulcrum extends through the central opening of each rocker arm associated with a particular cylinder and includes a top surface having a pocket formed therein with at least one internally splined through hole for each valve that can be selectively deactivated, and a bottom surface with a pivot ball socket formed therein for each valve that that can not be deactivated. A plunger having an external spline along at least a portion of its length is disposed within each through hole of the fulcrum and slidable between an activated position and a deactivated position. The plunger includes a pivot ball socket at one end and is adapted to receive a lost motion torsional spring leg at an opposite end. A latching mechanism associated with each plunger includes an internally splined latch gear disposed within the pocket of the fulcrum and rotatable between an activated position that limits sliding movement of the plunger by misalignment of the internal spline of the latch gear and external spline of the plunger, and a deactivated position that aligns the internal spline of the latch gear with the external spline of the plunger to allow sliding movement of the plunger within the fulcrum plate. A lost motion torsional spring has a first spring leg in contact with an associated plunger and a second leg in contact with the fulcrum to provide a biasing force that resists sliding movement of the associated plunger within the through hole as the plunger moves in response to the rocker arm when in the deactivated mode and returns the plunger to the activated position during the base circle portion of the camshaft rotation. A solenoid is positioned above the rocker arm cover and mechanically coupled by a hexagonal shaft to a drive gear disposed within the pocket of the fulcrum and coupled to at least one latch gear to rotate the drive gear and associated latch gear(s) between activated and deactivated positions in response to a command signal.

One embodiment of a method for deactivating an intake/exhaust valve in an internal combustion engine according to the present disclosure includes rotating a latch gear between an activated position that prevents a pivot ball plunger from sliding within a corresponding bore in a fulcrum so that the rocker arm pivots about the pivot ball to open an associated gas exchange valve, and a deactivated position that allows the plunger to slide within the corresponding bore in the fulcrum such that the rocker arm motion is insufficient to open the associated gas exchange valve.

The present disclosure includes embodiments having various advantages. For example, the systems and methods of the present disclosure provide valve deactivation for a multiple-valve-per-cylinder spark-ignition or compression-ignition internal combustion engine using low-cost, net-formed components with little or no machining, and a latching mechanism that does not add mass to the active valvetrain. The latching system is contained on a fulcrum assembly that is interchangeable with a standard fulcrum assembly so that no modification of the cylinder head is necessary. Actuation of the system uses rotary motion so there is no sensitivity to linear G-loads and is driven by a mechanically coupled (no hydraulics), fast-acting solenoid to provide reliable timing of the actuation. Direct coupling of the actuating solenoid does not require modification of the engine lubrication system, and provides reliable actuation unaffected by low or varying oil pressure that is common at low engine speeds. In addition, the direct-acting solenoid of the present disclosure provides a fast-acting latching mechanism that can be ganged to deactivate multiple valves using a single solenoid. The actuating solenoid may be mounted outside of the rocker cover so the solenoid is not susceptible to engine oil contamination and is easily accessible for control wire assembly and any subsequent servicing.

The above advantages and other advantages and features will be readily apparent from the following detailed description of the preferred embodiments when taken in connection with the accompanying drawings.

DETAILED DESCRIPTION OF THE PREFERRED EMBODIMENT(S)

Figure 1:
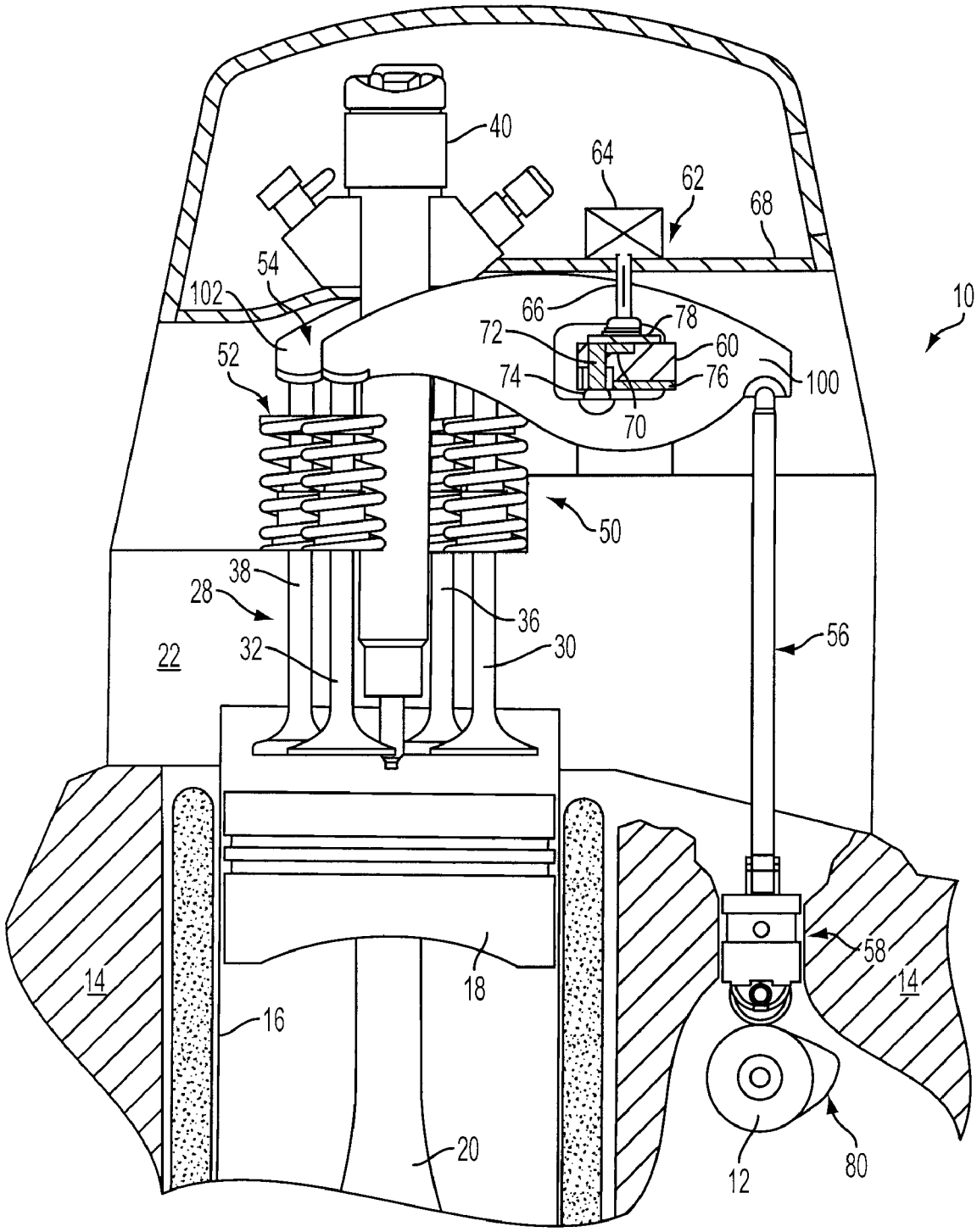
FIG. 1 is a partial cross-section illustrating one embodiment of an internal combustion engine having an intake/exhaust valve selective deactivation system according to the present disclosure.

As those of ordinary skill in the art will understand, various features of the embodiments illustrated and described with reference to any one of the Figures may be combined with features illustrated in one or more other Figures to produce alternative embodiments that are not explicitly illustrated or described. The combinations of features illustrated provide representative embodiments for typical applications. However, various combinations and modifications of the features consistent with the teachings of the present disclosure may be desired for particular applications or implementations. The representative embodiments used in the illustrations relate generally to a four-stroke, multi-cylinder, direct-injected compression-ignition internal combustion engine having a cam-in-block or pushrod valvetrain. Those of ordinary skill in the art may recognize similar applications or implementations with other engine/vehicle technologies, including but not limited to spark-ignited engines having single or dual overhead cam valvetrains, for example.

FIGS. 1-4 illustrate operation of an internal combustion engine having a valvetrain with at least one selectively deactivated valve according to a representative embodiment of the present invention. Multiple-cylinder internal combustion engine 10 is generally of conventional design with the exception of various valvetrain components to provide selective deactivation of one or more intake/exhaust valves as described herein. As such, various conventional features associated with the engine and valvetrain are not explicitly illustrated or described. Those of ordinary skill in the art will recognize that the present invention may be used in various types and configurations of engines including but not limited to compression ignition and spark ignition engines arranged in a "V" configuration or an in-line configuration, for example. The representative embodiments illustrated to describe the invention include a four valve per cylinder compression-ignition diesel engine. However, the present invention may be used in any applications having at least two gas exchange valves including applications having at least one intake valve and at least one exhaust valve. Similarly, the invention is particularly suited for use in engines having multiple valves controlled simultaneously by a single camshaft lobe and lifter due to its compact design, although the invention may also be used in applications where separate lifters are used to actuate each valve. While the present invention is illustrated in a cam-in-block engine configuration using pushrods to actuate the intake and exhaust valves (also referred to as a type-5 valvetrain), the invention may also be applied to applications where the rocker arms are directly actuated by a camshaft via a lifter (also referred to as a type-4 valvetrain). Those of ordinary skill in the art will recognize various other engine configurations in which a rocker arm assembly according to the present invention may be beneficial.

As shown in the partial cut-away/cross-section of a representative application in FIG. 1, multiple cylinder internal combustion engine 10 includes a camshaft 12 disposed within an engine block 14, and may be referred to as a cam-in-block engine. Each cylinder 16 (only one of which is shown) includes a reciprocating piston 18 coupled by a connecting rod 20 to a crankshaft (not shown). Cylinder head 22 is secured to engine block 14 and provides conventional intake and exhaust passages (not shown) coupled to corresponding ports in cylinder head 22 (not shown) associated with gas exchange valves 28, which include intake valves 30, 32 and exhaust valves 36, 38. Cylinder head 22 includes conventional hardware such as valve guides, seats, etc. (not shown) associated with operation of gas exchange valves 28. A fuel injector 40 delivers fuel to cylinder 16 in response to a signal provided by an associated engine controller. Although a direct injection engine is illustrated in FIG. 1, the present invention may be used in engines having other fuel injection strategies, such as port injection, for example.

Engine 10 includes a valvetrain 50 to control intake of air and/or fuel (for port injected engines) into cylinder 16 and exhaust of combustion gases. Valvetrain 50 includes valves 28, valve springs 52, rocker arms 54, pushrods 56, and lifters 58, sometimes referred to as tappets or cam followers. Camshaft 12 includes lobes 70 to actuate valves 28. In one embodiment, camshaft 12 includes a single lobe to operate a pair of intake valves 30, 32 and another single lobe to operate a pair of associated exhaust valves 36 and 38. As such, each lifter 58 may include independently operable hydraulic lash adjusters to adjust lash associated with each of the pair of pushrods, rocker arms, and valves.

Figure 3:
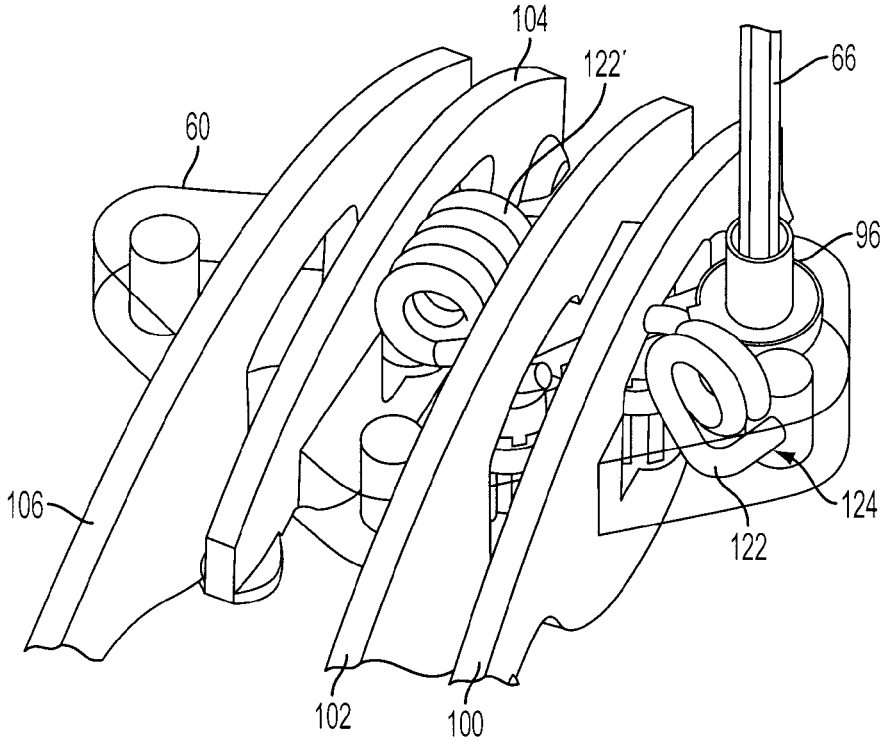
FIG. 3 is a partially assembled view of a valve deactivation mechanism according to one embodiment of the present disclosure.

Each valve 30, 32, 36, 38 has an associated independently pivotable rocker arm 100, 102, 104, 106 (best shown in FIG. 3). Rocker arms 54 associated with a cylinder are mounted on a corresponding fulcrum 60 secured to cylinder head 22. Rocker arms 54 pivot about a pivot ball 74 supported by fulcrum 60 to open an associated valve 28 with the valve closed by the force of an associated valve spring 52. Fulcrum 60 includes a selective valve deactivation device 62 driven by a rotary solenoid 64 mechanically coupled by a shaft 66 extending through rocker cover 68 and driving a latching mechanism 70 associated with a plunger 72 that supports pivot ball 74. Latching mechanism 70 and plunger 72 are contained within fulcrum 60 by a bottom plate 76 and top plate 78 as illustrated and described in greater detail herein, (see FIG. 4, for example).

In operation, lifter 58 contacts lobe 80 of camshaft 12. As camshaft 12 rotates, lobe 80 raises lifter 58 and associated pushrods 56 that exert corresponding forces on associated rocker arms 100, 102. Each rocker arm 100, 102 pivots in a single plane about a corresponding ball 74 supported by fulcrum 60. For valves that can not be selectively deactivated, pivot ball 74 is directly supported by a corresponding socket within the bottom surface of fulcrum 60. For valves associated with a selective deactivation device according to the present disclosure, pivot ball 74 is supported by a corresponding plunger 72 that is substantially fixed (after removal of mechanical lash by the initial 0.1 mm (approximately) of upward motion of the plunger 72) when in the valve activated mode. As such, for valves that can not be deactivated, and selectively deactivated valves in the activated mode, rocker arms 100, 102 pivot about corresponding pivot balls to translate the generally upward motion from pushrods 56 to a generally downward motion to move valves 28 against associated springs 52 to open associated intake/exhaust ports to cylinder 16. For selectively deactivated valves in the deactivated mode, plunger 72 slides within fulcrum 60 in response to upward motion of pushrod 56 such that the resulting pivoting motion of rocker arm 100 is reduced and insufficient to overcome the force of an associated valve spring 52 so that the associated intake/exhaust valve or valves remain closed.

Figure 2:
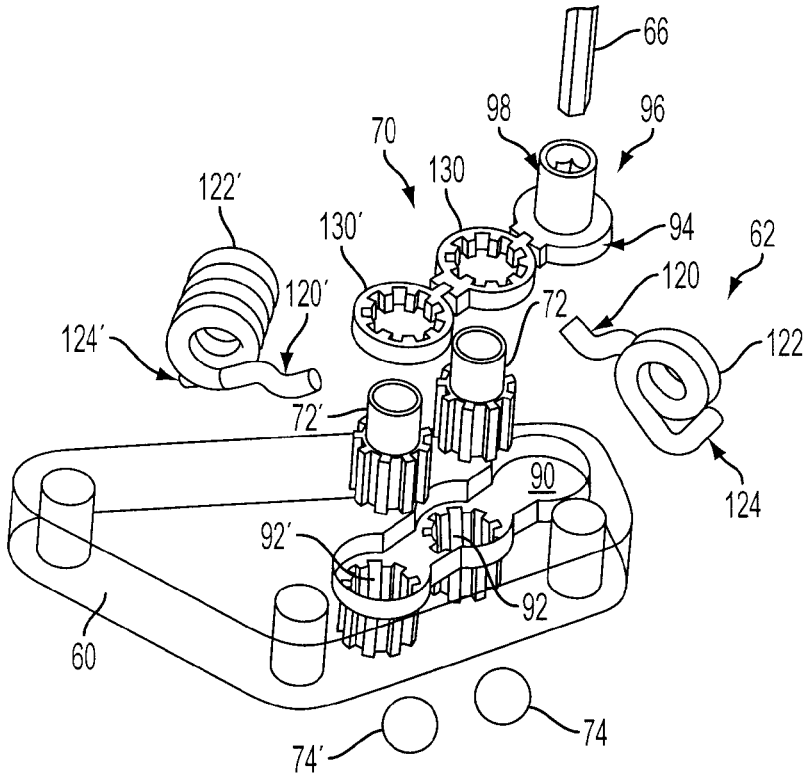
FIG. 2 is an assembly view illustrating components of a selective valve deactivation mechanism according to one embodiment of the present disclosure.

FIGS. 2-3 illustrate components in a selective valve deactivation device 62 according to one embodiment of the present disclosure. As will be appreciated by those of ordinary skill in the art, only those components associated with operation of the valve deactivation feature of the present disclosure are illustrated and described in detail. Components and details of the fulcrum 60 associated with operation of the remaining valves of the fulcrum are not shown. For example, the bottom surface of fulcrum body 60 includes pivot ball sockets formed therein to accommodate pivot balls associated with rocker arms 104, 106 for each valve that can not be deactivated. Similarly, FIG. 3 omits the top plate 78 and bottom plate 76 to better illustrate the relationship of various components as assembled that would otherwise be occluded.

Device 62 includes a fulcrum body 60 having a pocket 90 formed in a top surface. Pocket 90 includes through holes 92, 92' corresponding to each valve that can be selectively deactivated in addition to a recessed area for accommodating the base portion 94 of a drive gear 96. Through holes 92, 92' include at least one axially extending slot (or alternatively a key) extending along at least a portion of their length that cooperates with a corresponding key (or alternatively a slot) in associated plunger 72, 72' so that the plungers 72, 72' slide within respective through holes 92, 92' without rotating.

In one preferred embodiment, each plunger 72, 72' includes a an upper cylindrical portion without a spline or flutes ending in a top surface adapted to receive one end 120 of a torsional lost motion spring 122. The top surface of plungers 72, 72' may be generally concave as shown in FIGS. 2 and 3 to facilitate assembly and maintain contact with corresponding springs 122, 122', or may include other features, such as a U-shaped channel (FIG. 4) for example, depending upon the particular application and implementation. Plungers 72, 72' include a lower portion having an external straight spline with a plurality of axially extending and circumferentially equally spaced flutes with a total of nine (9) flutes about forty (40) degrees on center. Plungers 72, 72' include a lower end (not specifically illustrated) having a concave socket adapted for coupling to a corresponding pivot ball 74, 74', respectively. Through holes 92, 92' of fulcrum 60 may include a cooperating internal straight spline having a plurality of axially extending equally spaced flutes that allow plungers 72, 72' to slidingly engage the corresponding through hole 92, 92' without rotating.

Latching mechanism 70 includes latch gears 130, 130' disposed within pocket 90 of fulcrum 60. Latch gears 130, 130' include at least one internal key or slot, and preferably have an internal spline, that cooperates with a corresponding slot, key, or spline of the lower portion of plungers 72, 72', respectively to either allow or prevent sliding (with the exception of small movement associated with mechanical lash) of plungers 72, 72' within corresponding through holes 92, 92' depending on rotational position of latch gears 130, 130'. For example, in the valve-deactivated position, the internal spline of latch gears 130, 130' is aligned with the external spline of plungers 72, 72' to allow the corresponding flutes or teeth to mesh as the plungers slide within corresponding through holes 92, 92' and latch gears 130, 130' in response to upward motion of the rocker arms coupled to plungers 72, 72' via pivot balls 74, 74'. In the valve-activated position, latching gears 130, 130' are rotated by drive gear 96 so that the internal teeth of latching gears 130, 130' contact the external teeth of plungers 72, 72' and prevent the plungers from sliding within holes 92, 92'. To control the amount of lost motion stroke (or pre-stroke) that occurs prior to the start of valve motion to ensure precise valve events, latch gears 130, 130' are selected from a group of latch gears having different thicknesses during assembly of fulcrum 60. Different thicknesses may be provided by machining one side of the gears prior to assembly, or by various other manufacturing techniques depending upon the particular precision required.

Figure 4:
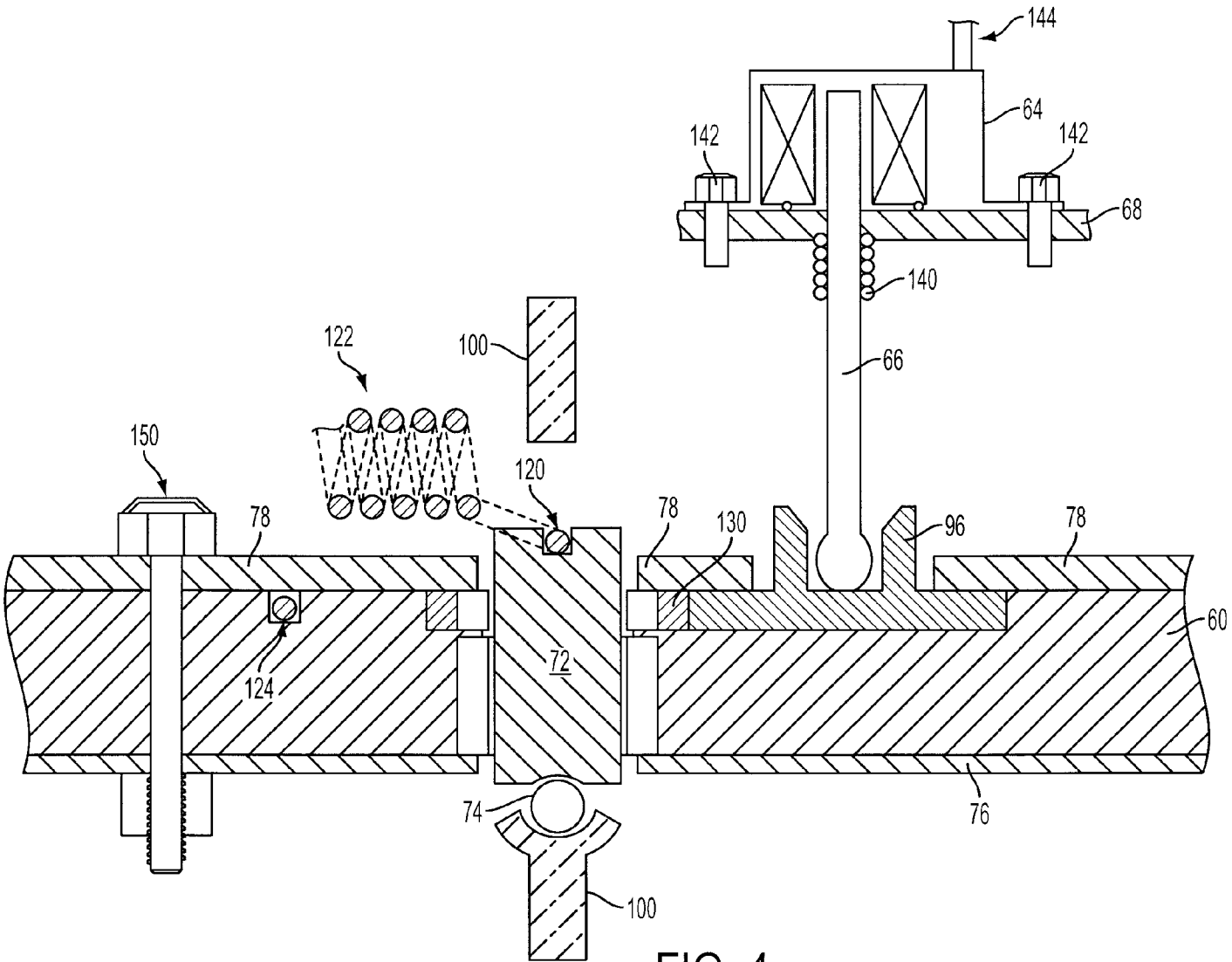
FIG. 4 is a partial cross-section illustrating operation of a valve deactivation mechanism according to one embodiment of the present disclosure.

As illustrated in FIG. 2, base portion of drive gear 94 and latch gears 130, 130' are disposed within pocket 90 of fulcrum 60. A top plate 78 (FIGS. 1, 4) secures latch gears 130, 130' and drive gear 96 within pocket 90 without inhibiting rotation of the gears within pocket 90. Top plate 78 provides a positive upward stop for latch gears 130, 130' against the upward force from associated rocker arms transmitted through pivot balls 74, 74' and plungers 72, 72' in the latched or valve-activated mode. Top plate 78 includes holes that allow the top portion 98 of drive gear 96 and the top portion of plungers 72, 72' to extend therethrough. Top portion 98 of drive gear 96 is adapted for mechanical coupling with shaft 66. In one embodiment, drive shaft 66 has a hexagonal cross-section with a spherical end to provide a compliant coupling with upper portion 98 of drive gear 96, which facilitates assembly of the coupling through rocker cover 68 (FIGS. 1, 4).

Drive gear 96 is directly mechanically coupled to latch gear 130, which is in turn directly mechanically coupled to latch gear 130'. This arrangement allows ganging of multiple latch gears that can be actuated substantially simultaneously by a single drive gear and associated solenoid. The direct mechanical coupling reduces complexity compared with hydraulically actuated systems, is not subject to varying oil pressure, and does not require interfacing with the engine lubrication system. In one embodiment, drive gear 96 includes a base portion 94 having at least one external projection that engages one or more corresponding external projections of latch gear 130. Similarly, latch gear 130 includes at least one external projection that engages a corresponding external projection on latch gear 130'. It is desirable to minimize backlash in the coupling of drive gear 96 and latch gears 130, 130' and any additional latch gears. In one embodiment, the coupling is designed to minimize backlash between latch gears 130, 130' and drive gear 96, which are rotated about twenty (20) degrees between latched and unlatched positions.

Lost motion torsional springs 122, 122' are positioned with one leg 120, 120' in contact with the top surface of a corresponding plunger 72, 72' and another leg 124, 124' in contact with fulcrum 60. Depending upon the particular implementation, legs 124, 124' may be positioned in a pocket or groove (not shown) in fulcrum 60 and captured or loosely held in place by top plate 78 (FIGS. 1, 4) or bottom plate 76 (FIGS. 1, 4), for example. Torsional springs 122, 122' provide a biasing or opposing downward force to plungers 72, 72' that resists upward sliding movement of plungers 72, 72' within corresponding holes 92, 92' during the valve-deactivated mode and returns plungers 92, 92' to the activated position during the base circle portion of the rotation of camshaft 12 (FIG. 1). The spring force of torsional springs 122, 122' is selected so that legs 120, 120' maintain contact with plungers 72, 72' as the plungers slide within fulcrum 60 during the valve-deactivated mode and provide a sufficient force so that the associated lash adjusters 58 (FIG. 1) operate properly, i.e. do not unnecessarily adjust in response to a change in activation mode. Spring force provided by torsional springs 122, 122' is also controlled relative to valve springs 52 (FIG. 1) so that rocker arm motion when in the valve-deactivated mode results in more of a translational movement (with some pivoting) as the plunger 72 slides within fulcrum 60 so that the rocker arm motion is insufficient to open the corresponding intake/exhaust valve.

Depending upon the particular application and implementation, spring force of torsional spring 122 or 122' may be selected so that the corresponding valve is opened even though latch gears 130, 130' are in the valve-deactivated position allowing plungers 72, 72' to slide within fulcrum 60. For example, selection of a torsional spring 122' having significantly higher spring force than torsional spring 122 operates to limit sliding movement of plunger 72' even when latch gear 130' is in the valve-deactivated position so that pivoting motion of rocker arm 102 (FIG. 3) is sufficient to open a corresponding valve, while motion of rocker arm 100 is insufficient to open a corresponding valve.

FIG. 4 is a partial cross-section illustrating operation of an intake/exhaust valve deactivation device according to the present disclosure. Solenoid 64 is disposed above rocker cover 68 and secured thereto by corresponding fasteners 142. It is desirable for solenoid 64 to be positioned above rocker cover 68 to facilitate assembly and connection of control wires 144 while preventing unnecessary exposure to engine lubricating oil. Solenoid 64 is preferably a type that has no sensitivity to linear G-loads, such as a rotary type brushless torque actuator, which is inherently more durable and has a flatter response. A rotary return spring 140 may be connected to solenoid 64 or shaft 66 to return drive gear 96 and associated latch gear 130 to a predetermined desired position when power is removed from solenoid 64, i.e. to position drive gear 96 in either the valve-activated or valve-deactivated position depending upon the particular application and implementation.

As previously described, top plate 78 is in contact with at least a portion of the top surface of fulcrum 60 to at least partially cover pocket 90 (FIG. 2) to capture drive gear 96 and latch gear 130. Top plate 78 may also optionally cover another recess, pocket, or groove to capture leg 124 of spring 122. Top plate 78 is secured to bottom plate 76, which covers a portion of the lower surface of fulcrum 60, by corresponding fasteners 150. Top plate 78 provides an upward positive stop for latch gear 130 and plunger 72 when latch gear 130 is in the valve-activated position as shown. During operation, when solenoid 64 actuates drive gear 96 via shaft 66, drive gear 96 rotates directly coupled latch gear 130 (and any other latch gear coupled to latch gear 130) to the valve-deactivated position so that plunger 72 moves upward into sliding meshing engagement with latch gear 130, but does preferably does not contact top plate 78. In one embodiment, plunger 72 moves about 3.6 millimeters (mm) against opposing spring force of torsional spring 122 in response to movement of rocker arm 100 in the valve-deactivated position such that the rocker arm movement is insufficient to overcome the associated valve spring and the valve remains closed. As the camshaft 80 (FIG. 1) rotates through the base circle of the lobe associated with rocker arm 100, spring 122 returns plunger 72 to the activated position with bottom plate 76 providing a positive downward stop for plunger 72. When the power/control signal is removed from solenoid 64, return spring 140 rotates drive gear 96 via shaft 66 to the valve-activated position, which in turn rotates latch gear 130 so that the lower ends of the teeth/flutes on latch gear 130 contact the upper ends of the teeth/flutes on plunger 72 to limit sliding movement of plunger 72 within fulcrum 60.

Deactivation of one or more intake/exhaust valves for one or more cylinders may be controlled by a dedicated microprocessor-based controller or preferably is integrated into the engine and/or vehicle control strategy implemented by the program code within an engine control module (ECM), powertrain control module (PCM), or the like, in communication with solenoid 64. Deactivation of one or more valves/cylinders may be performed in response to various engine, vehicle, and/or ambient operating conditions to implement various functions or modes that may include providing variable displacement or cylinder cut-off to operate on a subset of cylinders, deactivation of one intake valve on a multiple intake valve-per-cylinder engine to improve swirl motion at selected engine speeds, and deactivating valves during engine starting and/or running to vary exhaust temperature and manage operating temperature of emission treatment devices, for example. Those of ordinary skill in the art will recognize various other applications for controlling selective valve deactivation according to the present disclosure.

As one of ordinary skill in the art will appreciate based on the device illustrated and described in FIGS. 1-4, a method for selectively deactivating a gas exchange valve of an internal combustion engine according to one embodiment of the present disclosure includes selectively rotating a latch gear to a valve-activated position that prevents the plunger from sliding within a corresponding bore in the fulcrum so that the associated rocker arm pivots about a pivot ball to open an associated gas exchange valve, and rotating the latch gear to a valve-deactivated position that allows the plunger to slide within a corresponding bore in the fulcrum such that the rocker arm motion is insufficient to overcome the valve spring to open the associated gas exchange valve. The method may also include biasing the plunger toward the activated position.

For embodiments having one or more latch gears including an internal spline with the associated plunger(s) including an external spline, a method for selectively deactivating an intake/exhaust valve may include rotating the latch gear to the deactivated position to align the internal spline of the latch gear with the external spline of the plunger to allow the plunger to slide within the latch gear in response to movement of the associated rocker arm so that the rocker arm motion is insufficient to open the associated intake/exhaust valve. Rotation of the latch gear to either the valve-activated position, or the valve-deactivated position may be performed by a rotary solenoid mechanically coupled to the latch gear in combination with a return spring that biases the latch gear in a desired position.

As such, embodiments of the present disclosure provide systems and methods for valve deactivation of one or more intake/exhaust valves of an internal combustion engine using low-cost, net-formed components with little or no machining, and a latching mechanism that does not add mass to the active valvetrain. The latching system is contained on a fulcrum assembly that is interchangeable with a standard fulcrum assembly so that no modification of the cylinder head is necessary. Actuation of the system uses rotary motion so there is no sensitivity to linear G-loads and is driven by a mechanically coupled (no hydraulics), fast-acting solenoid to provide reliable actuation times. Direct coupling of the actuating solenoid does not require modification of the engine lubrication system, and provides reliable actuation unaffected by low or varying oil pressure that is common at low engine speeds. In addition, the direct-acting solenoid provides a fast-acting latching mechanism that can be ganged to deactivate multiple valves using a single solenoid. The actuating solenoid may be mounted outside of the rocker cover so the solenoid is not susceptible to engine oil contamination and is easily accessible for control wire assembly and any subsequent servicing.

While the best mode has been described in detail, those familiar with the art will recognize various alternative designs and embodiments within the scope of the following claims. Several embodiments have been compared and contrasted. Some embodiments have been described as providing advantages or being preferred over other embodiments in regard to one or more desired characteristics. However, as one skilled in the art is aware, one or more characteristic may be comprised to achieve desired system attributes, which depend on the specific application. These attributes include, but are not limited to: cost, strength, durability, life cycle cost, marketability, appearance, packaging, size, serviceability, weight, manufacturability, ease of assembly, etc. The embodiments discussed herein that are described as inferior to another embodiment with respect to one or more characteristics are not outside the scope of the invention.

What is claimed:

1. An internal combustion engine having selectively deactivated intake and/or exhaust valves and independently pivotable rocker arms each associated with one of the valves, each rocker arm having a pivot ball cup, the internal combustion engine comprising:

a fulcrum plate having a through hole with an internal spline;

a plunger disposed within the through hole and slidable between an activated position and a deactivated position, the plunger having a lower portion with an external spline that slidingly engages the internal spline of the through hole and a pivot ball cup at one end; and a latching mechanism associated with the plunger, the latching mechanism preventing sliding movement of the plunger into the through hole of the fulcrum plate when in an activated position, and allowing sliding movement of the plunger into the through hole of the fulcrum plate when in a deactivated position.

2. The internal combustion engine of claim 1 further comprising:

a spring having a first end in contact with the fulcrum plate and a second end in contact with the plunger opposite the pivot ball cup, the spring biasing the plunger toward the activated position.

3. The internal combustion engine of claim 2 wherein the plunger includes a second end having a U-shaped extension for engaging one end of the spring.

4. The internal combustion engine of claim 1 further comprising:

an electrical actuator coupled to the latching mechanism to selectively move the latching mechanism between activated and deactivated positions in response to a control command.

5. An internal combustion engine having selectively deactivated intake and/or exhaust valves and independently pivotable rocker arms each associated with one of the valves, each rocker arm having a pivot ball cup, the internal combustion engine comprising:

a fulcrum plate having a through hole with an internal spline;

a plunger disposed within the through hole and slidable between an activated position and a deactivated position, the plunger having a pivot ball cup at one end;

a latching mechanism associated with the plunger, the latching mechanism preventing sliding movement of the plunger into the through hole of the fulcrum plate when in an activated position, and allowing sliding movement of the plunger into the through hole of the fulcrum plate when in a deactivated position; and an electrical actuator coupled to the latching mechanism to selectively move the latching mechanism between activated and deactivated positions in response to a control command, wherein the electrical actuator is positioned above a rocker arm cover of the internal combustion engine and is mechanically coupled to the latching mechanism by a shaft extending therebetween.

6. The internal combustion engine of claim 1 wherein the latching mechanism includes a latch gear having an internal spline that cooperates with the external spline of the plunger to allow the external spline of the plunger to slide within the latch gear when in the deactivated position, and to prevent the external spline of the plunger from sliding within the latch gear when in the activated position.

7. The internal combustion engine of claim 6 wherein the latch gear includes at least one external tooth directly coupled to a second latch gear associated with a second one of the valves such that rotation of the latch gear between activated and deactivated positions substantially simultaneously rotates the second latch gear between activated and deactivated positions, respectively.

8. The internal combustion engine of claim 1 wherein the latching mechanism actuates a plurality of ganged together latch gears to selectively activate and deactivate a corresponding plurality of valves substantially simultaneously.

9. The internal combustion engine of claim 1 wherein the fulcrum plate and plunger are constructed of powdered metal to finish dimensions without machining.

10. The internal combustion engine of claim 1 wherein the rocker arms are actuated by a camshaft coupled to the rocker arms by corresponding push rods.

11. An internal combustion engine having a plurality of gas exchange valves associated with each cylinder with at least one valve selectively deactivated in response to a command signal, the internal combustion engine comprising:

a plurality of rocker arms each associated with one of the gas exchange valves, each rocker arm including a central opening defined by a bottom wall having a pivot ball socket formed therein and first and second side walls extending from the bottom wall to a top wall;

a fulcrum generally extending through the central opening of each rocker arm and having a top surface with a pocket formed therein with at least one through hole for each valve that can be selectively deactivated, and a bottom surface with a pivot ball socket formed therein for each valve that can not be deactivated;

a plunger disposed within each through hole of the fulcrum and slidable between an activated position and a deactivated position, the plunger including a pivot ball socket at one end and adapted to receive a spring leg at an opposite end;

a latching mechanism associated with each plunger, the latching mechanism including a latch gear disposed within the pocket of the fulcrum and movable between an activated position that limits sliding movement of the plunger and a deactivated position that allows sliding movement of the plunger;

a torsional spring having a first spring leg in contact with an associated plunger and a second leg in contact with the fulcrum to provide a biasing force that resists sliding movement of the associated plunger within the through hole;

a pivot ball disposed between each rocker arm socket and a corresponding pivot ball socket of an associated plunger or the fulcrum; and a solenoid mechanically coupled to the latching mechanism to move the latching mechanism between the activated position and the deactivated position in response to a command signal.

12. The internal combustion engine of claim 11 wherein the fulcrum further comprises at least one axial slot extending at least partially trough each through hole associated with a plunger and wherein each plunger includes at least one axial key that slidingly engages a corresponding axial slot to prevent rotation of the plunger within the through hole.

13. The internal combustion engine of claim 12 wherein the fulcrum further comprises through holes having an internal spline that engages a corresponding external spline extending along at least a portion of an associated plunger.

14. The internal combustion engine of claim 13 wherein the latching mechanism comprises a latch gear having an internal spline that aligns with the external spline of the plunger to allow the plunger to slide within the latch gear when in the deactivated position.

15. The internal combustion engine of claim 11 wherein the solenoid comprises a rotary solenoid disposed above a rocker cover of the engine, the internal combustion engine further comprising:

a drive gear disposed within the pocket of the fulcrum and mechanically linked to the latching mechanism; and a shaft extending between the solenoid and the drive gear to mechanically couple the drive gear to the solenoid.

16. The internal combustion engine of claim 11 further comprising:

a top plate in contact with an upper surface of the fulcrum and extending over at least a portion of the pocket in the fulcrum to secure the latching mechanism within the pocket and provide a positive upward stop for the latching mechanism and plunger when operating in the activated position; and a bottom plate in contact with a bottom surface of the fulcrum and extending over at least a portion of the at least one through hole in the fulcrum to provide a positive downward stop for each plunger, the bottom plate secured to the top plate and fulcrum.

17. A method for selectively deactivating a gas exchange valve of an internal combustion engine having a valvetrain with a plurality of independently pivotable rocker arms each associated with one gas exchange valve, each rocker arm including a central opening defined by a bottom wall having a pivot ball socket formed therein and first and second side walls extending from the bottom wall to a top wall and a fulcrum generally extending through the central opening of each rocker arm, the fulcrum having a plunger that supports a pivot ball disposed between the plunger and corresponding rocker arm socket, the method comprising:

rotating a latch gear having a spline cooperating with a spline on the fulcrum between an activated position that prevents the plunger from sliding within a corresponding bore in the fulcrum so that the rocker arm pivots about the pivot ball to open an associated gas exchange valve and a deactivated position that allows the plunger to slide within the corresponding bore in the fulcrum such that the rockerarms motion is insufficient to open the associated gas exchange valve.

18. The method of claim 17 wherein the latch gear includes an internal spline and the plunger includes an external spline and wherein rotating the latch gear to the deactivated position aligns the internal spline of the latch gear with the external spline of the plunger to allow the plunger to slide within the latch gear in response to movement of the associated rocker arm.

19. The method of claim 17 further comprising biasing the plunger toward the activated position.

* * * * *